United States Patent [19]

Schiron et al.

[11] 4,170,796

[45] Oct. 16, 1979

[54] SWIMMING POOL WITH PROTECTIVE WALL

[76] Inventors: Klaus Schiron, Nelkenstrasse 2, 3100 Celle; Hans F. Rupprath, Am goldenen Acker 35, 3001 Bennigsen, both of Fed. Rep. of Germany

[21] Appl. No.: 812,810

[22] Filed: Jul. 5, 1977

[30] Foreign Application Priority Data

Jul. 2, 1976 [DE] Fed. Rep. of Germany ..... 2629856

[51] Int. Cl.[2] ..... E04H 3/18

[52] U.S. Cl. ..... 4/172; 4/172.11; 4/172.16

[58] Field of Search ..... 4/172, 172.11, 172.13, 4/172.15, 172.16, 172.19, 185.2, 166, 167, 187 R, 1, DIG. 0.5, 172.18, 172.14, 172.12; 61/26; 405/104, 107

[56] References Cited

U.S. PATENT DOCUMENTS

| | | | |
|---|---|---|---|
| 1,404,969 | 1/1922 | Kassebaum | 61/26 |
| 2,982,970 | 5/1961 | Kennedy | 4/172.18 |
| 3,473,334 | 10/1969 | Dexter | 4/172.16 X |
| 3,546,719 | 12/1970 | Bishop | 4/172.17 |
| 3,579,660 | 5/1971 | Whitaker | 4/185 L |

FOREIGN PATENT DOCUMENTS

| | | | |
|---|---|---|---|
| 7400875 | 4/1974 | Fed. Rep. of Germany | 4/172 |

*Primary Examiner*—Stuart S. Levy
*Attorney, Agent, or Firm*—Thomas E. Beall, Jr.

[57] ABSTRACT

In a rectangular swimming pool suitable for use as a wave bath there is provided a rigid protective wall extending along and adjacent to the two longitudinal walls and one transverse wall and able to be raised above the level of the edge of the swimming pool so as to contain the waves during wave operation and to be retraced to the level of the edge of the pool during normal operation.

5 Claims, 1 Drawing Figure

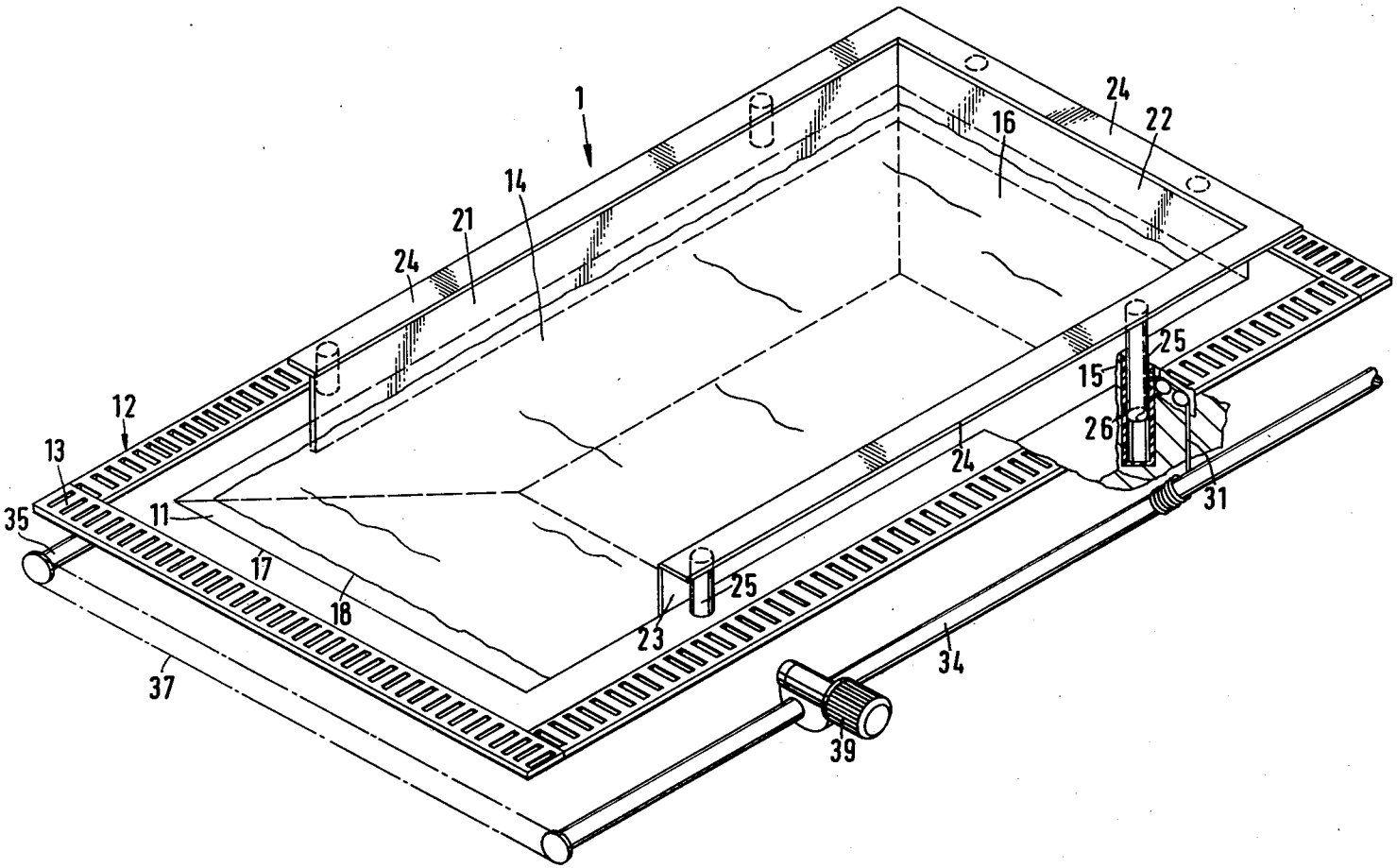
1
11
12
13
14
15
16
17
18
21
22
23
24
25
26
31
34
35
37
39

SWIMMING POOL WITH PROTECTIVE WALL

BACKGROUND OF THE INVENTION

1. Field of Invention

The invention relates to a swimming pool suitable for use with wave operation having two longitudinal walls and two transverse walls and a protective wall which at least partially surrounds the edge of the swimming pool and whose height relative to the edge may be adjusted.

2. Description of Prior Art

In order to be able to use a conventional swimming pool as a wave bath it must either be so arranged that the calm water level is 60 to 70 cm. below the edge of the pool or the calm water level must be lowered by a corresponding amount. However, a swimming pool with such a low water level is no longer suitable for modern day use. Visually its appearance is unsatisfactory, it is conducive to accidents, it is scarcely usable for sporting purposes and furthermore it is unfavourable for ventilation due to chlorine fumes which accumulate above the water surface. To prepare a swimming pool with a water level at the same height as the pool edge for use as a wave bath the water level must be lowered, for which purpose so-called water level lowering devices are necessary. These include for example water reservoirs arranged beneath the swimming pool into which water may be run off until the required lowering of the water level has been achieved. The cost of installation of such water reservoirs is considerable. No less, however, is the technical expenditure required to return the water by means of compressed air or pump action after the swimming pool has been used as a wave bath. For this purpose a power connection of over 80 kilowatts may be necessary if the swimming pool is to be filled again within three to six minutes. A severe problem still remains of cleaning such water reservoirs which are accessible only with difficulty.

In order to be able to convert a swimming pool for wave operation without the need to lower the water level a splash wall installation is known (German Gebrauchsmuster No. 7,400,875) in which a plurality of chambers in the form of tubular tyres whose size may be altered are arranged and secured above one another, at least to one end wall of the swimming pool, and which may be altered in size vertically by inflating them. The height of this splash wall can be reduced by emptying the individual chambers, for which purpose a so-called storage chamber is provided in the floor within which the deflated tyres are to be positioned. Associated with such a splash wall installation is the disadvantage that its use in modern pools, which must be rapidly converted from normal use to wave operation and vice versa, is in practice impossible. On the one hand filling the individual tyres or chambers with compressed air takes a considerable time during which no orderly use of the swimming pool is possible. On the other hand, completely emptying the inflated tyres produces considerable difficulties since the deflation against atmospheric pressure is only possible by the mechanical application of pressure or by special suction devices. Furthermore inflatable walls necessitate a large floor space. Naturally such inflatable walls are also not safe against vandalism which is today frequent in public swimming pools. In practice a small leak in one of the chambers suffices to render the whole installation inoperable.

3. Object of Invention

It is one of the main objects of the invention to be able to convert swimming pools for wave operation without great technical expenditure, economically and rapidly.

SUMMARY OF THE INVENTION

This object is achieved in accordance with the invention in that the protective wall is rigid and is arranged so as to be mechanically liftable above the water level of the swimming pool in the region of the two longitudinal walls and at least one transverse wall.

By this means is achieved a rigid construction of a splash protection wall necessary for wave operation in modern swimming pools filled to the pool edge, which wall may be simply, rapidly and reliably raised even when wave operation is used two or three times an hour. Such rigid walls take up only a small amount of the floor area since their thickness is generally only a few centimeters. It is possible to use the installation without incurring great expense in newly constructed baths and also in baths which are already in existence by, so to speak, "hanging it in the pool" so that the pool periphery is practically unaffected. It is also possible to arrange steps or ladders on such a rigid vertically moveable protective wall which will then be be moved up and down with it.

For reasons of constructional simplicity in accordance with one particular embodiment of the invention the protective wall is of platelike construction. It may be arranged so as to be vertically displaceable in a well or recess situated in the longitudinal walls and the transverse wall. The protective wall may be arranged to be vertically moveable in the swimming pool immediately adjacent the longitudinal walls and the transverse wall. For these embodiments plates of plastics material, suitably prepared wood or concrete are preferably used for the protective walls. Transparent plastics material is particularly suitable, thus enabling special transparency effects to be achieved i.e. a view into the pool from outside.

In order to particularly ensure friction-free operation the protective wall may be supported so as to be vertically moveable by means of at least two guide columns arranged in or on the longitudinal walls and the transverse wall. The guide columns may be moveable within guide cylinders comprising plastics tubes, which cylinders are set into the longitudinal walls and the transverse wall. These embodiments enable the use of lifting elements which are rapidly operable, and of cheap guide elements for the protective wall which at the same time are corrosion resistant and maintenance free.

In order to be able to move the protective wall rapidly, reliably and cheaply and above all to be able to lift large and heavy protective walls, e.g. made of concrete, using simple technical means the guide cylinders may comprise hydraulically operable lifting cylinders. In an alternative preferred construction winding shafts are associated with the guide columns of the protective wall and connected by means of cables or chains, the winding shafts being separate but commonly or synchronously driveable. This necessitates only very few constructional measures.

Furthermore the protective wall can be connected to its associated guide columns by means of a sill formed as a support. When the protective wall is retracted this forms an aesthetically pleasing and safe construction of the swimming pool surround.

In order to facilitate installation, and to enable easily transportable prefabricated components to be used, the protective wall preferably comprises a plurality of component protective walls each of which is situated in the region of the two longitudinal walls and the transverse wall respectively.

BRIEF DESCRIPTION OF THE DRAWINGS

Other and further objects of the present invention will be apparent from the following description and claims and are illustrated in the accompanying drawings which by way of illustration show preferred embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims.

In the schematic drawing there is shown an axonometric view of a swimming pool of rectangular plan view.

DESCRIPTION OF THE PREFERRED EMBODIMENT

A swimming pool 1 of rectangular plan view is defined by two opposing longitudinal walls 14, 15, transverse walls 16, 17 and a floor which is not shown. An overflow 12 covered by a grating 13 is arranged around the edge 11 of the swimming pool 1. The water level 18 is at the same height as the edge 11 of the swimming pool 1. A protective wall 21 is shown in a raised position along and immediately adjacent the longitudinal wall 14. A protective wall 23 is also shown in a raised position situated immediately adjacent the other longitudinal wall 15. A protective wall 22 is shown immediately adjacent the transverse wall 16 also in a raised position and together with the two other protective walls 21 and 23 forms a closed U-shaped surround to the swimming pool projecting at least 60 or 70 cm. above the water level 18. The transverse wall 17 has no protective wall. At their point of contact the protective walls 21, 22, 23 are sealed by means of an overlap or by means of flexible sealing elements. For the sake of simplicity the protective walls are shown here as being of unitary construction. The protective walls carry sills 24 at their upper edges extending perpendicularly outwards which are adapted to transmit the weight and the lifting force of the protective walls 21, 22, 23. The protective walls 21, 22, 23 are each supported on two guide columns 25, of which only those of the longitudinal wall 15 may be seen, whilst those of the other longitudinal wall 14 and transverse wall 16 are merely schematically indicated. Each guide column 25 is moveable within a guide cylinder 26 which comprises for instance a plastics tube, set into the concrete of the respective pool wall 14, 15, 16 in a suitable manner. In the swimming pool 1 shown in the drawing winding shafts 34, 35 are arranged in channels situated beneath the overflow 12, the winding shafts 34 and 35 being parallel to the longitudinal walls 15 and 14 respectively. Each of the winding shafts 34, 35 is connected to the foot of the two guide columns 25 by a chain or cable 31 which is carried by two rollers which are not shown. One winding shaft 34 is connected to a drive motor 39 by a drive chain and also to the other winding shaft 35 by means of a synchronous drive 37 which is only shown schematically. A winding shaft with cables which are not shown and which can, for example, be connected to and driven by one or both winding shafts 34, 35 by means of a cone pulley drive which is not shown, is associated with the protective wall 22, too.

When not in use, the protective walls 21, 22, 23 are in a lowered position and situated within the swimming pool 1. The sills 24 connected to them lie against the edge 12 of the swimming pool 1 and may be walked on without hinderance. The protective walls 21, 22, 23 situated along the length of the walls of the swimming pool 1 are recognisable, if at all, only by their colour. If it is wished to convert the swimming pool 1 to a wave bath, or to start the wave action, for which a wave machine or the like is positioned in the region of the transverse wall 16 while the floor is inclined in direction of the transverse wall 17 so as to form a surface on which the waves may break and run down, it is merely necessary to actuate the drive motor 39 by switching it on and thus turning the winding shaft 34 in a clockwise direction. By winding the cables 31 on to the winding shafts 34, 35 the guide columns 25 are lifted in their guide cylinders 26 and thus raise the protective walls 21, 22, 23 with their upper edges or sills 24 to about 70 cm. above the water level 18. All the protective walls are lifted simultaneously and to the same height above the water level 18 due to the synchronous drive of the winding shaft 35 and the winding shaft of the protective wall 22. This lifting process is effected within a few minutes so that the swimming pool 1 may then be used as a wave bath. When it is no longer required to use it as a wave bath the swimming pool may again be returned to the form in which it is suitable for sporting purposes by reversing the previous movements.

The material for the protective walls 21, 22, 23 may be chosen in accordance with the dimensions of the swimming pool 1. Plates of P.V.C., acrylic resin or other plastics enable special effects to be achieved due to their colouring or transparency. Furthermore water resistant glued chipboard or concrete may be used. Various types of lifting means, either of the mechanical type or of the hydraulic type may be used.

Structurally and statically the protective walls are so dimensioned that they can resist the force of waves having a height of about 60 to 70 cm. They may be raised by a relatively small motor. The time over which they are raised can be chosen to be so low that there is no danger of an accident, but nevertheless the conversion proceeds in an extremely short space of time by comparison with conventional types of convertable pools. So as to obviate possible malfunctioning an automatic control is conveniently provided between the drive motor and wave machine.

It will be appreciated that many modifications may be be made to this specific embodiment which is described by way of example only. Whilst the protective wall has been described as being within the swimming pool immediately adjacent its walls, the protective wall may be accomodated within, and mounted to rise out of, a well or elongate recess situated around the swimming pool so that in its retracted position only the sill 24 will be visible.

ADDITIONAL EXPLANATION

While the term "protective wall" throughout the aforegoing specification with the exceptance of the DESCRIPTION OF THE PREFERRED EMBODIMENT and also in the claims has been used for the splash protection installation as a whole, the same term has been used for each of the elements 21, 22, and 23 of said splash protection installation in the DESCRIPTION OF THE PREFERRED EMBODIMENT.

What is claimed is:

1. A swimming pool suitable for selective use as a normal bathing pool and as a pool with wave operation, comprising:

two longitudinal fixed generally vertical walls, two transverse fixed generally vertical walls and a bottom fixed wall all joined together to form a fixed unitary open topped container for water and defining a swimming area having around its entire uppermost periphery a fixed overflow edge;

a continuous U-shaped rigid protective generally vertical wall at least partially surrounding the swimming area within the region of said two longitudinal walls and one of said tranverse walls, and having an uppermost peripheral edge;

means mounting said protective wall so as to be movable vertically between a lowered position with said peripheral edge being substantially no higher than said overflow edge, and a raised position with said peripheral edge being spaced above said overflow edge and above any other fixed swimming pool water confining structure;

said protective wall having a substantial vertical extent at least as great as the vertical distance between said positions so as to provide wave protection in said raised position from said peripheral edge to said overflow edge;

mechanical means for selectively lifting and lowering said protective wall between its lowered position and its raised position;

said protective wall including one plate extending along and generally coextensive with the upper portion of said one transverse wall, and two plates extending along and generally coextensive with the uppermost portion of said two longitudinal walls at least for a major length of said two longitudinal walls;

said protective wall further including a plate flange extending outwardly from the upper edge of each of said plates to define said peripheral edge and overlie said overflow edge in said lower position;

said mounting means including a plurality of cylinders embedded in said two longitudinal walls and said one transverse wall, and a corresponding plurality of columns respectively telescopically received within said cylinders, and having their uppermost ends rigidly secured to said plate flange.

2. A swimming pool as claimed in claim 1, wherein said mounting means provides a vertically measured spacing between said lowered position and said raised position of at least 60 centimeters.

3. A swimming pool suitable for selective use as a normal bathing pool and as a pool with wave operation, comprising:

two longitudinal fixed generally vertical walls, two transverse fixed generally vertical walls and a bottom fixed wall all joined together to form a fixed unitary open topped container for water and defining a swimming area having around its entire uppermost periphery a fixed overflow edge;

a continuous U-shaped rigid protective generally vertical wall at least partially surrounding the swimming area within the region of said two longitudinal walls and one of said transverse walls, and having an uppermost peripheral edge;

means mounting said protective wall so as to be movable vertically between a lowered position with said peripheral edge being substantially no higher than said overflow edge, and a raised position with said peripheral edge being spaced above said overflow edge and above any other fixed swimming pool water confining structure;

said protective wall having a substantial vertical extent at least as great as the vertical distance between said positions so as to provide wave protection in said raised position from said peripheral edge to said overflow edge;

mechanical means for selectively lifting and lowering said protective wall between its lowered position and its raised position;

said protective wall including one plate extending along and generally coextensive with the upper portion of said one transverse wall, and two plates extending along and generally coextensive with the uppermost portion of said two longitudinal walls at least for a major length of said two longitudinal walls;

said protective wall further including a plate flange extending outwardly from the upper edge of each of said plates to define said peripheral edge and overlie said overflow edge in said lowered position; and said mounting means being embedded in said two longitudinal walls and said one transverse wall, and having its exposed portions covered by said plate flange in the lowered position.

4. A swimming pool as claimed in claim 3, further including a horizontal grating extending continuously around the entire periphery of and spaced outwardly from said overflow edge for receiving the overflow, said grating being spaced from the overflow edge a distance at least equal to the outwardly extending width of said plate flange such that the plate flange does not interfere with the grating in the lowered position; and said plate flange closing off the gap between the protective wall plates and to the adjacent pool walls in the lowered position.

5. A swimming pool suitable for selective use as a normal bathing pool and as a pool with wave operation, comprising:

two longitudinal fixed generally vertical walls, two transverse fixed generally vertical walls and a bottom fixed wall all joined together to form a fixed unitary open topped container for water and defining a swimming area having around its entire uppermost periphery a fixed overflow edge;

a continuous U-shaped rigid protective generally vertical wall at least partially surrounding the swimming area within the region of said two longitudinal walls and one of said transverse walls, and having an uppermost peripheral edge;

means mounting said protective wall so as to be movable vertically between a lowered position with said peripheral edge being substantially no higher than said overflow edge, and a raised position with said peripheral edge being spaced above said overflow edge and above any other fixed swimming pool water confining structure;

said protective wall having a substantial vertical extent at least as great as the vertical distance between said positions so as to provide wave protection in said raised position from said peripheral edge to said overflow edge;

said protective wall including one plate extending along and generally coextensive with the upper portion of said one transverse wall, and two plates extending along and generally coextensive with the uppermost portion of said two longitudinal walls at least for a major length of said two longitudinal walls;

said protective wall further including a plate flange extending outwardly from the upper edge of each of said plates to define said peripheral edge, and said plate flange overlying said overflow edge and closing off the gap between the protective wall plates and the adjacent pool walls in said lower position;

mechanical means beneath said plate flange for selectively lifting and lowering said protective wall between its lowered position and its raised position; and a horizontal grating extending continuously around the entire periphery of and spaced outwardly from said overflow edge for receiving the overflow, said grating being spaced from the overflow edge a distance at least equal to the outwardly extending width of said plate flange such that the plate flange does not interfere with the grating in the lowered position.

* * * * *